United States Patent [19]

Ringdahl et al.

[11] Patent Number: 4,874,021

[45] Date of Patent: Oct. 17, 1989

[54] ASEPTIC FILLING UNIT FOR PACKING MACHINES FOR LONG-LASTING PRODUCTS WITH FLUID BEHAVIOR

[75] Inventors: Ulf Ringdahl, Löddeköpinge, Sweden; Vittorio Mattei, Modena, Italy

[73] Assignee: Tetra Dev-Co., Modena, Italy

[21] Appl. No.: 205,499

[22] Filed: Jun. 8, 1988

Related U.S. Application Data

[63] Continuation of Ser. No. 812,401, Dec. 20, 1985, abandoned.

[30] Foreign Application Priority Data

Dec. 28, 1984 [IT] Italy ..... 24286/84

[51] Int. Cl.[4] ..... B65B 3/04

[52] U.S. Cl. ..... 141/85; 134/95; 134/98; 137/238; 137/240

[58] Field of Search ..... 134/95, 94, 98, 103, 134/171; 137/15, 238, 239, 240, 241; 222/148; 141/85, 89, 90, 91; 53/127

[56] References Cited

U.S. PATENT DOCUMENTS

| | | | |
|---|---|---|---|
| 3,435,834 | 4/1969 | Cooper | 134/98 |
| 3,643,679 | 2/1972 | Hansson | 137/241 |
| 3,650,678 | 3/1972 | Hansen | 137/241 X |
| 3,693,640 | 9/1972 | Wettlen et al. | 134/169 R |
| 3,716,083 | 2/1973 | Tuma et al. | 141/90 |
| 3,911,642 | 10/1975 | Ernstsson et al. | 53/426 |
| 3,912,535 | 10/1975 | Rauser | 134/22 C |
| 3,970,426 | 7/1976 | Stark et al. | 422/24 |
| 4,213,795 | 7/1980 | Ernstsson et al. | 134/22 C |
| 4,218,265 | 8/1980 | Fuchs et al. | 134/18 |
| 4,344,469 | 8/1982 | Brown | 141/90 |
| 4,465,210 | 8/1984 | Iwanami | 137/238 X |
| 4,502,614 | 3/1985 | Weiler et al. | 222/148 |
| 4,516,596 | 5/1985 | Sugisawa et al. | 222/148 X |
| 4,570,665 | 2/1986 | Zimmerly | 137/241 X |
| 4,608,810 | 9/1986 | Bordini | 53/551 |
| 4,617,779 | 10/1986 | Nygren et al. | 53/433 |

FOREIGN PATENT DOCUMENTS

| | | | |
|---|---|---|---|
| 2064074 | 8/1979 | Fed. Rep. of Germany . | |
| 1599388 | 8/1970 | France . | |
| 1174326 | 8/1985 | U.S.S.R. | 141/89 |
| 1222239 | 2/1971 | United Kingdom . | |

*Primary Examiner*—Ernest G. Cusick

*Attorney, Agent, or Firm*—Burns, Doane, Swecker & Mathis

[57] ABSTRACT

For the manufacture of packing containers, and the packing inside such containers of long-lasting fluid products, such as liquids, semi-liquids or products containing solid particles, the product delivering and metering devices are an integral part of the packing machine. They condition and influence the structure and the operation thereof. An aseptic-filling unit according to the present invention is a modular element interposed between the packing machine and the product feeding line, and can be isolated from both of them.

9 Claims, 5 Drawing Sheets

ASEPTIC FILLING UNIT FOR PACKING MACHINES FOR LONG-LASTING PRODUCTS WITH FLUID BEHAVIOR

This application is a continuation of application Ser. No. 812,401, filed Dec. 20, 1985, abandoned.

FIELD OF THE INVENTION

The present invention relates to an aseptic filling unit.

BACKGROUND OF THE INVENTION

It is generally desirable in the packing industry, to provide types of packings, packing processes and related equipment, which make it possible to pack different types of food products, so as to preserve for as long as possible the original structure of the machinery, and the operating characteristics thereof.

The processing of liquid or semi-liquid food products for the purpose of conferring to them characteristics of long-life at room temperature within suitable containers, presupposes a sterilization carried out, e.g., by means of a so-called "UHT" (ultra-high temperature) plant. This includes a step of heating to 135°-150° C., a dwell step at this temperature and a step of cooling to about 20° C. with the subsequent delivery into the main distribution line to the aseptic packing machines. For the sterilization then of the machines and plants for packing long-lasting products, an operation cycle starts with the chemical washing of the components which will come into contact with the product.

In particular, the product delivery regulation and level control device must be washed, and it is usually at the end of the delivery pipe and placed inside the tube of packing material which is being formed. For such an operation to be made possible, the device is usually dismantled, with consequent time and production losses.

Moreover, regulation devices positioned inside the product within the tube of packing material being formed do not seem particularly suitable and universal with the varying of the density of the product to be packed, especially if they operate on the basis of hydrostatic or hydrodynamic principles. It is thus necessary to replace and fit them to the liquid or semi-liquid products, and to the presence of solid particles.

OBJECTS AND SUMMARY OF THE INVENTION

A purpose of the present invention is to provide an aseptic filling unit independent of the packing machine and the delivery line of the product to be packed.

Another purpose is to have a packing unit aseptic and easily washable and sterilizable even when inside the main distribution line of a sterile product.

Another purpose is to make it possible to carry out a rather precise metering of the product contents within the single packing produced.

Another purpose is that the metering unit of the filling unit be suitable for easy replacement by another, so as to make it more suitable to the product being processed and packed, without thereby substantially influencing the structure and the operation of the packing machine.

These and further purposes according to the present invention are achieved by providing a unit for the aseptic filling of long-lasting fluid products into containers. The unit is provided for packing machines of the type wherein a pipe feeds said product from a sterilization unit, into containers, means for sealing the said containers also being provided. The unit is positioned between said product feed pipe and said product sterilization assembly. It substantially comprises a couple of valve groups, between which a unit functionally useful to the filling process is connected by related pipes.

Preferably said unit functionally useful to the filling is a metering unit.

In a preferred embodiment, a sterilization assembly is centralized and said unit is inserted in a branched line of a centralized line connected to said sterilization unit for the purpose of feeding a plurality of packing machines, a pump being provided for circulating the product in said line.

Advantageously, at least one of the valve groups is connected through a pipe to washing units, with related valve means being interposed.

BRIEF DESCRIPTION OF THE DRAWING

The structural and functional characteristics and the advantages of a unit according to the present invention will be better understood from an exemplifying, not limiting preferred embodiment thereof, referring to the related schematic drawings.

DETAILED DESCRIPTION

Figure 2:
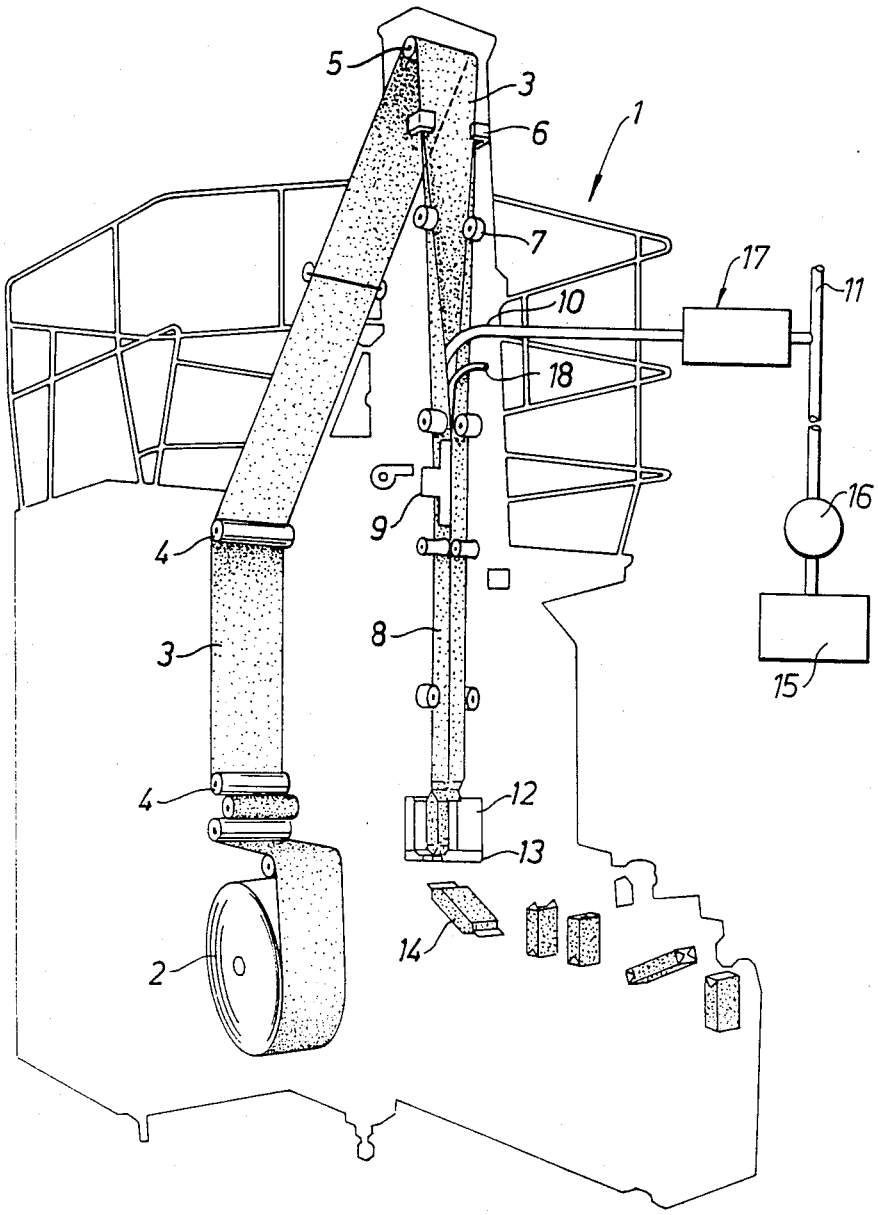
FIG. 2 is a front elevational view, partially schematic, of a packing machine provided in a packing line.

With reference to FIG. 2, a packing machine generally indicated by reference numeral 1, is of a general type previously known, which converts web-like packing material into individual packing containers. The packing material is of the laminate type, generally comprising a central carrier layer of paper, which is coated on both sides with thin layers impermeable to liquid, made of thermoplastic material, e.g., of polyethylene. The packing laminate web 3 is provided with crease lines for the purpose of facilitating the folding and conversion thereof into finished packing containers. The web 3 is supplied to the packing machine 1 in the form of a roll 2 which is suspended in such a way, as to be capable of rotating in the suitable section of the packing machine. From the storage roll the web of packing material 3 travels through a certain number of guide rollers 4 up to the upper part of the machine, where it is sterilized by known methods. After having been sterilized, the web 3 travels on a reversal roller 5 for continuing travelling thereafter essentially vertically downwards, through the packing machine, in a sterile closed chamber (not shown).

With the aid of various folding and forming elements 6, 7, positioned along the travelling path of the web of material 3, the web of packing material 3 is subsequently tubularly shaped in a known manner during its run downwards, so as to obtain a tube of packing material 8 with a longitudinal liquid-tight seal. The seal is made by a sealing unit 9 which can operate on the basis of different principles. Simultaneously to the forming of the tube of packing material, the product to be packed is delivered to fill the lower portion thereof through one or more feeding pipe(s) 10. This or these pipe(s) are introduced through the upper-open-end of the tube of packing material, up to a suitable depth. The delivery pipe therefore extends essentially concentrically downwards through the tube of packing material, and opens at a short distance above the lower end. At a certain distance under the delivery pipe 10, forming and sealing jaws 12, 13 are positioned on both sides of the packing material tube 8 to act, cooperating as pairs with each other, on the tube of packing material 8. Said jaws are positioned in such a way, as to seal the tube of packing material at similar intervals along sealing zones.

By means of a series of combined movements, a packing container 14 is obtained in a formed shape and separated from the tube of packing material. After the separation has taken place, the packing container 14 is conveyed further on by means of a conveyor (not shown) for the purpose of continuing the processing and the final shaping thereof, so as to produce a packing container of the desired shape (in this case of parallelepipedon shape).

Figure 1:
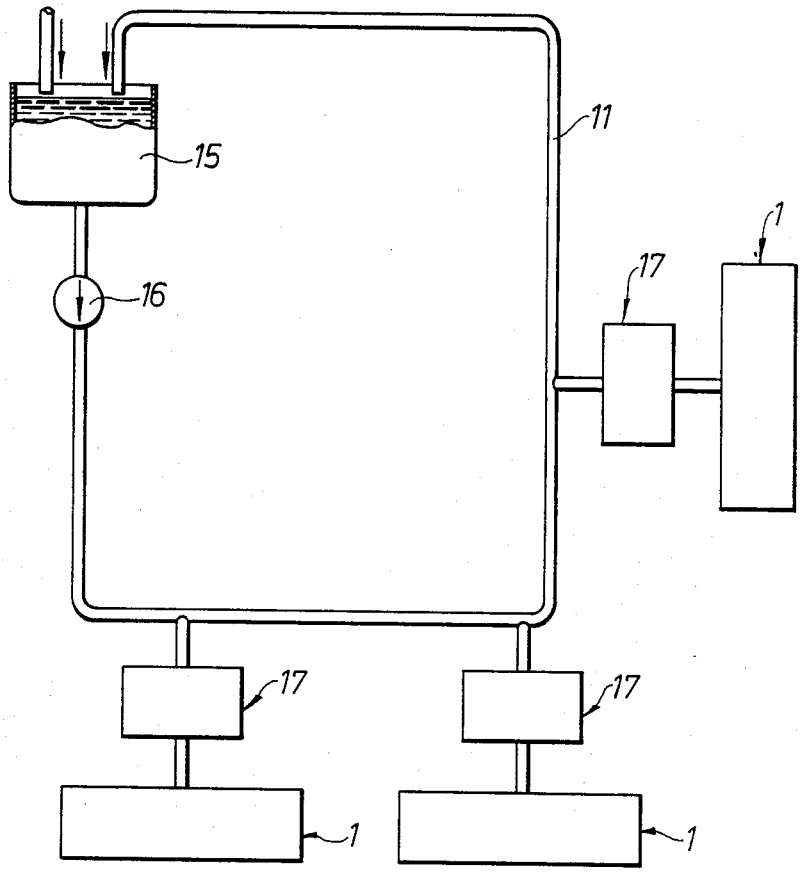
FIG. 1 is a schematic view of a packing line with a plurality of aseptic filling units and machines inserted therein.

The pipe 10 for the delivery and/or loading of the product to be packed is connected, e.g., (FIG. 1) to a centralized product-distribution line or pipe 11, fed with sterilized product from a centralized sterilizer 15 or tank with the aid of a pump 16.

Line 11 (FIG. 1) serves, e.g., a series of packing machines and related filling units 17 and returns to the tank 15, into which raw product is fed from the outside.

Between the single packing machine 1 and the centralized line 11 a filling unit according to the present invention is interposed, generally indicated with 17.

Figure 3:
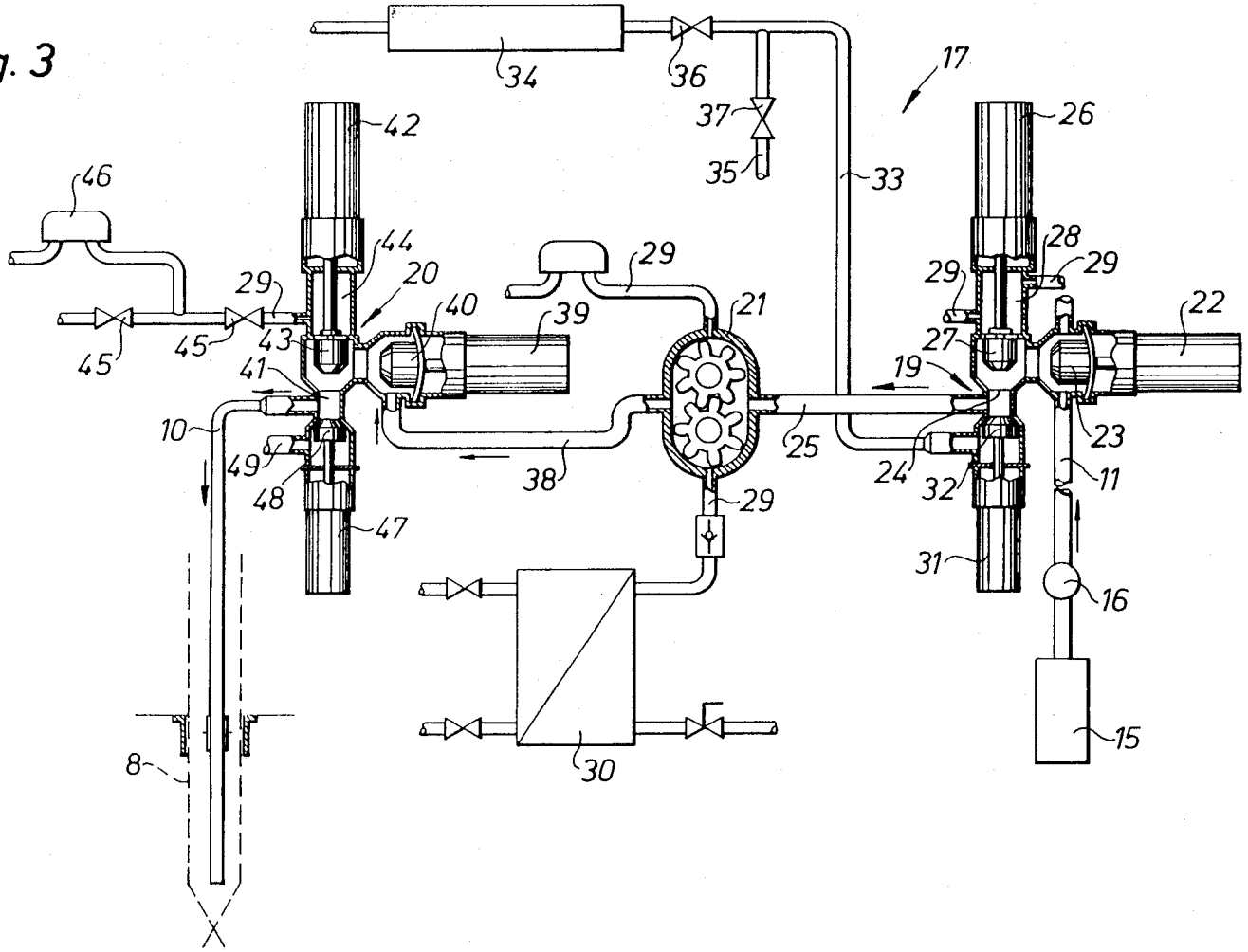
FIG. 3 is a schematic view, partially in cross section of a filling unit according to the present invention in production stage.
Figure 4:
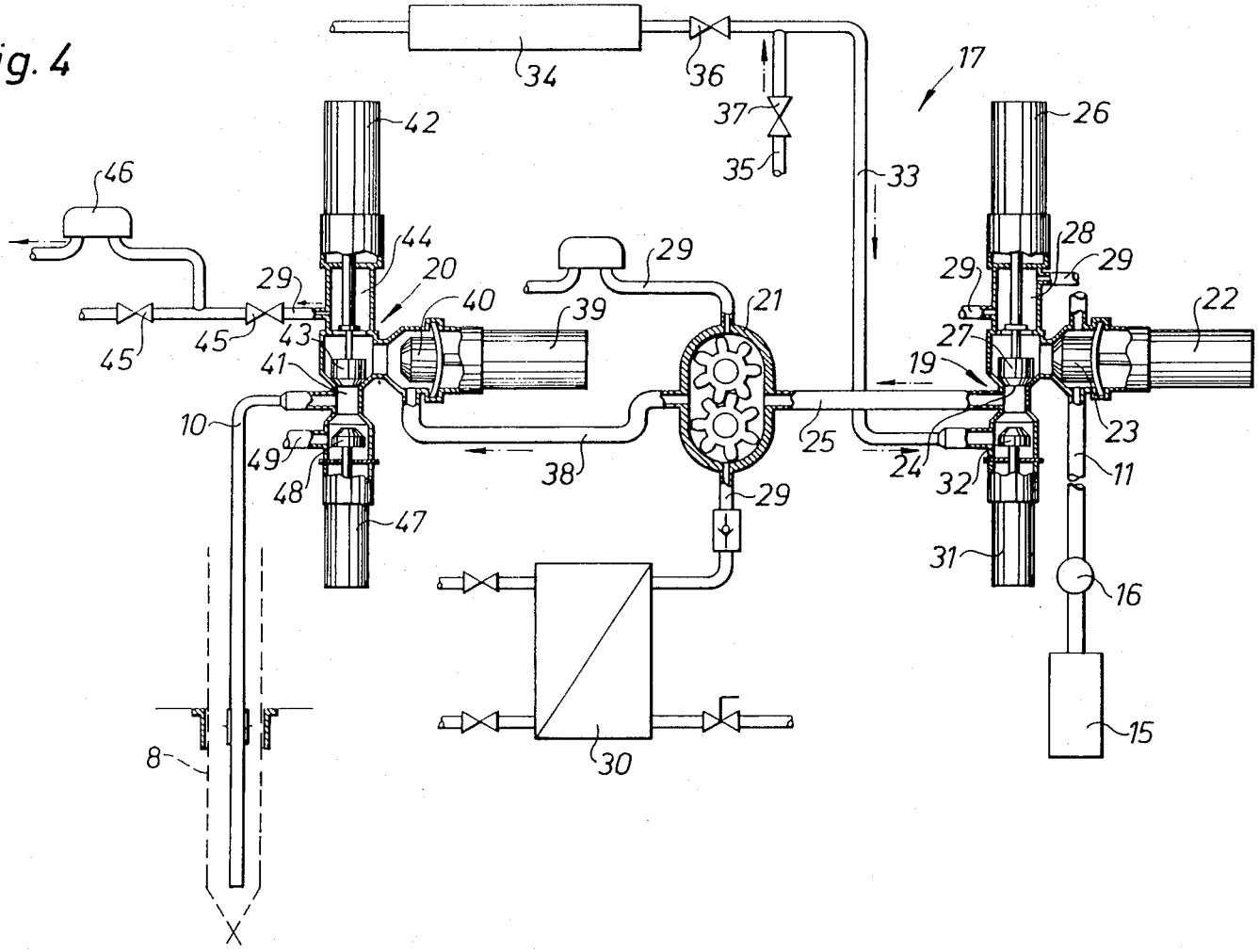
FIG. 4 is a view of the unit of FIG. 3 in preheating and/or sterilization stage.
Figure 5:
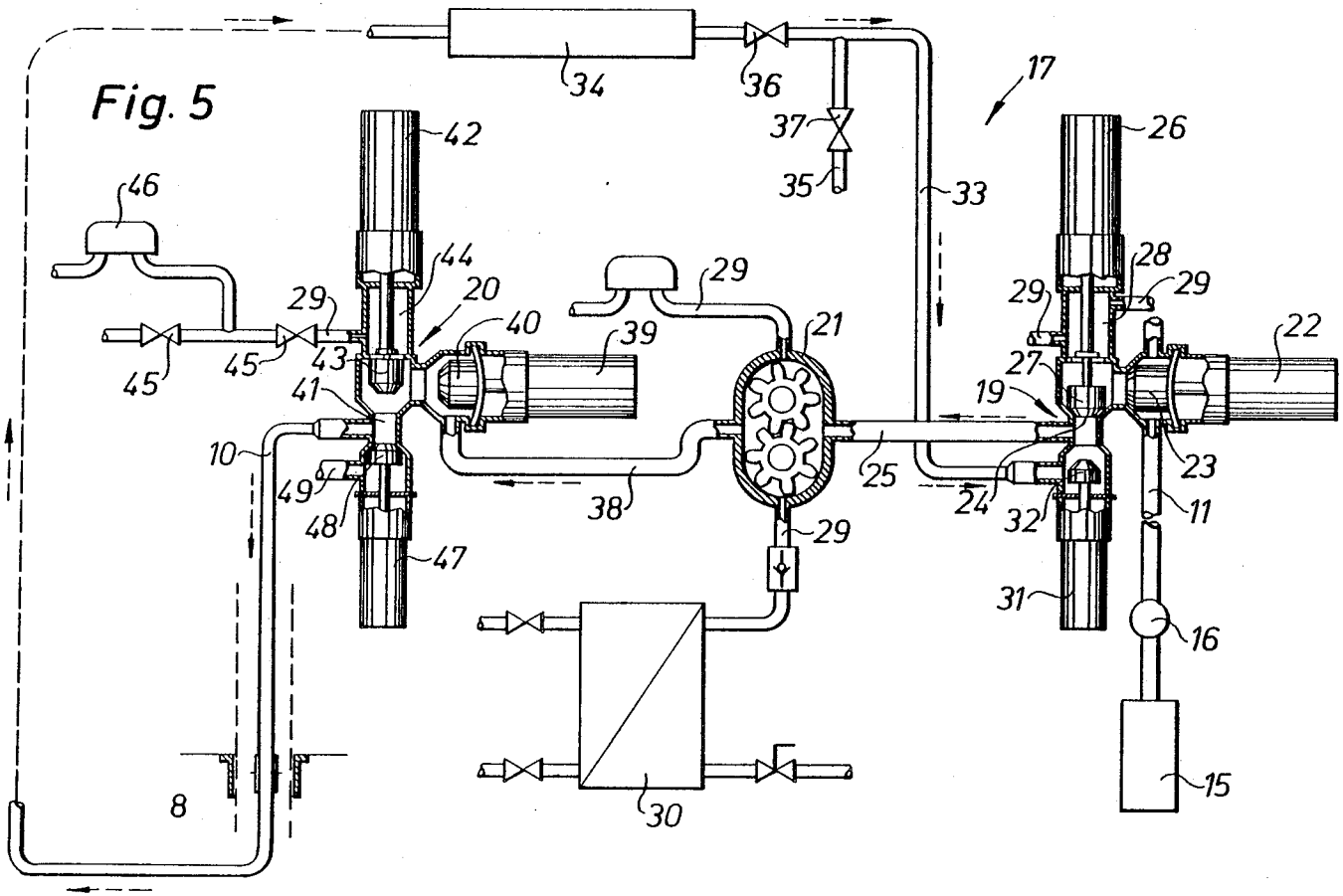
FIG. 5 is a view of the unit of FIG. 3 in the non-aseptic chemical washing stage.

As shown in FIGS. 3–5, the filling unit 17 receives the product from the line 11 and delivers it via the pipe 10 to the interior of the tube of packing material 8.

According to a known way, a sealing device (not shown) is positioned around the feeding pipe 10, made, e.g., of flexible material, and rests against the inner wall surface of the tube of packing material 8, so as to form a tight seal. Moreover, sterile gas or air is conveyed via a feeding pipe 18 into the space existing at the lower end of the tube tightly sealed by the sealing device above mentioned, this space being constantly held at a slight overpressure by the forced feeding of sterile air or gas.

The filling unit 17 consists essentially of a pair of valve groups 19, 20, between which a unit functionally useful for the filling is interposed, e.g., a metering unit such as a pump.

The first valve group 19 comprises a first valve 22 whose shutter element 23 allows selectively the communication between the line 11 and a portion 24 of a duct 25 communicating with the pump 21. A second valve 26, by means of a related shutter 27, connects selectively the portion 24 to a chamber 28 within which, via pipes 29, sterile steam is fed, such as, e.g., created by a central generator 30.

A third valve 31, by means of a related shutter 32, connects selectively the portion 24 of the duct 25 to a pipe 33, which is connected both to a centralized washing unit 34 and to a pipe 35 of sterile steam, by related valve means 36, 37.

The second valve group 20 communicates with the pump 21 via a duct 38, where a first valve 39 is provided with a related shutter 40 for selective interruption towards a portion 41 of the same duct 38.

A second valve 42, by means of a related shutter 43, selectively connects the portion 41 to a chamber 44, which in turn may be connected with or isolated from the outside by valve means 45. Condensate discharge and/or recovery means 46 is also connected to the chamber 44 via the valve means 45. A third valve 47 connects selectively, by means of a shutter 48, the pipe 10 to the portion 41 and to a further pipe 49 for feeding a sterilizing gas to the pipe 10.

The valve 42 constitutes with its mower seat the border between the aseptic filling unit and the packing machine.

The valve 47 belongs to the packing machine and the movements thereof are dictated by the machine operating program.

Also the shaft of the pump 21, together with its related sealing elements, are submitted via the pipe 29 to sterile condensate generated in a condenser 30. An aseptic filling unit provided according to the present invention is, during its normal operation in the condition as shown in FIG. 3, and the product follows the path identified by the full line arrows.

For this to be possible, in the first valve group 19 the shutter 23 is retracted and allows the connection between the line 11 and the portion 24 of the duct 25, while the shutters 27 and 32 are in their closed positions.

In the second valve group 20 the shutter 40 is retracted, and allows communication between the duct 38 and its portion 41 communicating with the pipe 10.

The shutters 43 and 48 are so positioned, as to close the pipe 29 and the pipe 49.

The presence of the metering element or pump 21 in each packing machine 1 allows the single containers 14 to be filled with a predetermined dosage, even if the product exhibits a certain compactness, because of the presence of solid particles in a large quantity.

If for any particular occurrence the packing is to be stopped for the lack of aseptic conditions, a local sterilizing can be undertaken of the filling unit 17 without causing any inconveniences to the line and to the other packing machines. The inlet of the product can be stopped by acting on the shutter 23 of the valve 22, thus preventing the delivery from the line 11 (FIG. 4).

The valves 26 and 31 are then actuated, so as to allow the sterile steam to respectively enter the portion 24 and the duct 25, coming from the pipe 33 after having opened the valve means 37.

The sterile steam passes, following the path indicated by the point-dotted arrows, through the pump 21 and the duct 38 and, the shutter 43 having been preliminarly moved to close the portion 41, fills the chamber 44, for which it escapes out of the filling unit 17.

After having carried out a pre-heating, along the same path of the arrows of FIG. 4, steam at 130°–140° C. is circulated for a certain time, so as to sterilize the whole unit. The chamber 28 is used as an antiseptic seal barrier.

After the feeding of sterile steam has been stopped, by repositioning the valves and their related shutters as shown in FIG. 3, the production is started again under aseptic conditions.

If then one wants to carry out a washing stage at the end of the cycle, or if replacement is wished of the metering unit following a changing of the product to be packed, one operates (FIG. 5) so as to connect the filling unit 17 to a centralized washing unit 34.

The valve means 36 is opened and the shutter 32 is lowered, not before having closed and isolated by the shutter 23 the unit 17 from the line 11.

The shutter 27 is then lowered to close the duct 25, thus causing the inlet of sterile steam into the portion 24 and into the chamber 28.

As for the second valve group 20, no actuation thereof is commanded, but the end of the pipe 10 is connected to the washing unit 34 to form a closed loop after the tube of material 8 has been removed, or through the open end of the same tube. The washing chemical liquid circulates according to the dotted arrows of FIG. 5.

Such a washing is carried out by means of a suitable liquid under non aseptic conditions and it serves to remove residues, above all of solid particles, sticking on the various components of the filling unit.

After this treatment, a further pre-heating, a sterilization and possibly a cooling, as previously described, must be carried out prior to restarting the packing.

Advantageously, for replacing the metering element 21, no intervention is necessary on the sterilizing system of the packing machine.

The installed metering element 21 is so evident, that it can be washed and subsequently sterilized without incurring danger of contaminating the sterile line 11 because of the presence of steam in the intermediate portion between the shutters 23 and 27.

It is advantageous to note that the easy and quick dismantling of a metering element for replacing it with another element allows the single packing machine 1 to be fitted to the packing of products having different characteristics.

The presence of metering units of different types and adjustable as desired, makes it moreover possible to carry out a packing, with the same product, in a desired and predetermined amount, e.g., with the container completely filled, or with an upper empty space.

What is claimed is:

1. In an apparatus for the aseptic filling of fluid products into containers, by means of packing machines of the type wherein a feed pipe feeds the products from a supply line under sterile conditions into said containers, the improvement comprising:

a metering unit for metering the fluid products to be fed into the containers, said metering unit arranged between a feed pipe and a supply line; isolation means for selectively connecting the metering unit to the supply line, the feed pipe, a source of sterlizing fluid, and a washing unit, said isolation means being positioned between said products feed pipe and said products supply line, said isolation means including two valve groups, between said valve groups the metering unit is connected by related pipes;

the isolation means including means for forming an aseptic seal barrier between the metering unit and the supply line and between the metering unit and the feed pipe; and wherein each of said valve groups has three valves.

2. The apparatus of claim 1, wherein said supply line is centralized, and said isolation means is located in a branched line connected to said supply line for the purpose of feeding one of said packing machines, a pump being provided for circulating the product in said centralized line.

3. The invention of claim 1, wherein said metering unit is a pump.

4. The apparatus of claim 1, wherein a first valve group of said two groups is placed upstream of the metering unit, said first valve group having an intermediate duct portion, a first valve which selectively connects said products supply line to a pipe connecting said metering unit with said first valve via said intermediate duct portion, a second valve for connecting the source of sterilizing fluid to said intermediate duct portion, and a third valve for selectively feeding a sterilizing fluid and a washing fluid to said metering unit when said first and second valves are closed.

5. The apparatus of claim 1, wherein a second valve group of said two groups is placed downstream of the metering unit, said second valve group having an intermediate duct portion, a first valve which connects selectively said products feed pipe to a pipe connecting said metering unit to the first valve via said intermediate duct portion, a second valve for circulating a sterilizing fluid to said intermediate duct portion, and a third valve for feeding a washing fluid to the products feed pipe.

6. Aseptic packaging apparatus, comprising:

a sterilization unit for sterilizing a liquid product to be packaged;

a feed unit for feeding the product into a container;

a metering unit connected by pipes between the sterilization unit and the feed unit;

a first valve group arranged between the sterilization unit and the metering unit, said first valve group having a first isolation valve for interrupting product flow between the sterilization unit and the metering unit and means for forming an aseptic seal between the sterilization unit and the metering unit; and a second valve group arranged between the metering unit and the feeding unit, said second valve group having a second isolation valve for interrupting product flow between said metering unit and said feed unit and means for forming an aseptic seal between the sterilization unit and the metering unit;

a source of sterilizing fluid connected to said first valve group; a washing unit connected to said first valve group;

wherein said first valve group includes means for selectively connecting the metering unit to the sterilization unit, the source of sterilizing fluid, and the washing unit.

7. The invention of claim 6, wherein said first valve group further includes a valve arranged between the first isolation valve and the metering unit for introducing a sterilizing fluid to the metering unit.

8. In an apparatus having a feed pipe and a supply line for the aseptic filling of fluid products into containers, wherein the feed pipe feeds the products from the supply line under sterile conditions into said containers, the improvement comprising:

a unit for metering the fluid products to be fed into the containers, said unit arranged between the feed pipe and the supply line;

isolation means for selectively connecting the unit to the supply line, the feed pipe, a source of sterilizing fluid, and a washing unit, said isolation means positioned between said feed pipe and said supply line, said isolation means including first and second valve groups, between said valve groups the unit is connected by related pipes, whereby the isolation means allows the unit to be isolated for cleaning and sterilization without contamination of the supply line or the feed pipe;

each of said valve groups includes three valves; and the first valve group, interconnecting the unit to the supply line, includes an aseptic seal barrier chamber for forming an aseptic seal barrier between the supply line and the unit, and the second valve group interconnects the unit to the feed pipe and includes an aseptic seal barrier chamber for forming an aseptic seal barrier between the feed pipe and the unit.

9. The invention of claim 8, wherein said unit is a metering unit.

* * * * *